United States Patent [19]

Brashears et al.

[11] Patent Number: 4,477,250

[45] Date of Patent: Oct. 16, 1984

[54] ASPHALT RECYCLE PLANT AND METHOD

[75] Inventors: David F. Brashears, Oviedo; Emanuel J. Elliott, Altamonte Springs; Theodore G. Butler, Orlando, all of Fla.

[73] Assignee: Mechtron International Corporation, Orlando, Fla.

[21] Appl. No.: 473,043

[22] Filed: Mar. 7, 1983

[51] Int. Cl.[3] ..... F27D 1/16; E01C 19/45; B02C 11/08

[52] U.S. Cl. ..... 432/3; 126/343.5 A; 241/23; 432/72

[58] Field of Search ..... 432/3, 72; 241/23; 126/343.5 A

[56] References Cited

U.S. PATENT DOCUMENTS

| | | | |
|---|---|---|---|
| 3,786,800 | 1/1974 | Heller | 126/343.5 A |
| 3,880,143 | 4/1975 | Hart et al. | 126/343.5 A |
| 4,253,940 | 3/1981 | Price | 241/23 |
| 4,309,113 | 1/1982 | Mendenhall | 432/72 |

*Primary Examiner*—John J. Camby

*Attorney, Agent, or Firm*—William M. Hobby, III

[57] ABSTRACT

An asphalt recycling system and process are incorporated into an existing batch type asphalt plant. The existing asphalt plant has an aggregate dryer and air discharge ducts connected to a filtering system. A recycling dryer has input ducts connected to the existing aggregate dryer discharge ducts and output ducts connected from the recycling dryer back to the existing ducts to the filtering system. A recycle feeder bin for feeding reclaimed asphalt pavement to the recycle dryer is connected to the recycle dryer. A recycle booster burner is operatively connected to the recycle dryer through the input duct to the dryer for providing additional heat to the recycle dryer so that the waste heat from the existing aggregate dryer and the booster burner provide a predetermined heat to the recycle dryer for heating the asphalt material. A recycling storage bin or silo is connected to receive the heated recycled asphalt from the recycle dryer. A hammermill or other means may be provided for breaking up the old asphaltic materials, such as old paving materials prior to entry of the material into the recycle dryer. Dampers are provided for directing heated gases from the existing batch type asphalt plant to the recycling system, as needed, and temperature controls are utilized to control the recycled booster burner to provide the right combination of existing waste and added heat for the recycled dryer. The stored recycled asphalt materials may be fed to an existing plant batching tower for batching and loading into vehicles.

16 Claims, 3 Drawing Figures

ASPHALT RECYCLE PLANT AND METHOD

BACKGROUND OF THE INVENTION

The present invention relates to asphalt plants and especially to batch type asphalt plants to which an asphalt recycling system is added for utilizing old asphaltic pavement materials, and the like, to produce high quality new paving materials.

In the past, asphalt plants have generally been of two types, one being of the type where the aggregate is dried and mixed with the liquid bitumen in the dryer and the other being a batch type where the liquid bitumen is mixed with the aggregate later in the mixer crimping mill. Batch type plants typically have hopper feeds for feeding different size cold aggregate materials by means of a cold feed conveyor into the dryer. The dryer typically involves a large elongated drum having a burner directed into one end, with the aggregate being fed therethrough from the other end, and providing rotation of the drum with flights for mixing the aggregate material with the hot gases and causing it to be dried. As the material passes through the drum, the hot air and gases from the burner pass out the other end of the dryer into a ducting system which is directed towards a wet wash, mechanical collector, or fabric filter dust collector for cleaning the air and gases prior to their discharge from a stack. Meanwhile, the dried aggregate materials are fed up a slat type hot elevator to a batching tower, where the material is passed through screens for separating it into sizes and asphalt liquid from an asphalt storage tank is fed into the weigh box or mixer at the bottom of the tower, along with mineral fillers and mixed with the aggregate prior to loading into a truck.

Entire plants are typically controlled by a control room having the plant controls. This type of plant has been commonly used around the world, but has the disadvantage of not being able to process old, used asphaltic pavement materials. The present invention is specifically directed to add to an existing batch type asphalt plant a used asphalt recycle plant utilizing the waste heated air and gases from the existing batch type plant, as well as the existing filter system, and being controlled to provide additional heated gases as needed along with controls for cutting in the recycling plant as needed.

It is accordingly, an aim of the present invention to recycle existing asphalt materials utilizing waste heat and other components of an existing batch type asphalt type plant.

SUMMARY OF THE INVENTION

The present invention provides for an asphalt recycling system and a process of recycling asphalt materials, such as old used pavement materials, at an existing batch type asphalt plant thereby requiring less heat to recycle the material and smaller amounts of liquid asphalt and filler minerals while utilizing existing components such as the existing plant filtering system.

The existing asphalt plant has an aggregate dryer having gas discharge ducts connected to a filtering system. A recycling dryer has input ducts connected to the output duct of the existing plant dryer and has outlet duct from the recycling dryer connected back into the duct to the filtering system. Dampers allow the recycling dryer to be cut in or out, as desired, while a recycle booster burner is operatively connected to the recycled dryer for providing additional heat to the recycle dryer control to maintain the temperature at a predetermined desired level. A recycle feeder bin is positioned to feed the old asphaltic materials to the recycle dryer and a hammermill, or the like, may be used to break up the used asphaltic materials to a predetermined aggregate size. A recycle storage bin or silo is connected to receive and store the heated recycled asphalt from the recycle dryer and may be connected to the existing batching tower of the asphalt plant for blending with other aggregates and materials. Temperature sensors can sense the temperature in the output of the recycling dryer for controlling the recycling booster burner to maintain the output temperature by controlling the recycled booster burner. Processes for recycling asphaltic materials included breaking up the old asphaltic materials and feeding the old asphaltic materials to recycle dryer. Any gases are directed from an aggregate plant asphalt dryer into the recycle dryer and the asphaltic materials are heated in the recycle dryer. The adding of heated air to the recycle dryer by the recycle burner allows the heat in the recycle dryer to be controlled to a predetermined level while utilizing waste heat from the asphalt plant. The exhaust gases from the recycle dryer are then fed to the asphalt plant's filtering system by way of the existing input duct to the filtering system. Heated used asphaltic materials are fed to an asphalt storage bin and may be fed to an existing batching tower.

BRIEF DESCRIPTION OF THE DRAWINGS

Other objects, features and advantages of the present invention will be apparent from the written description and the drawings, in which.

DESCRIPTION OF THE PREFERRED EMBODIMENTS

Figure 1:
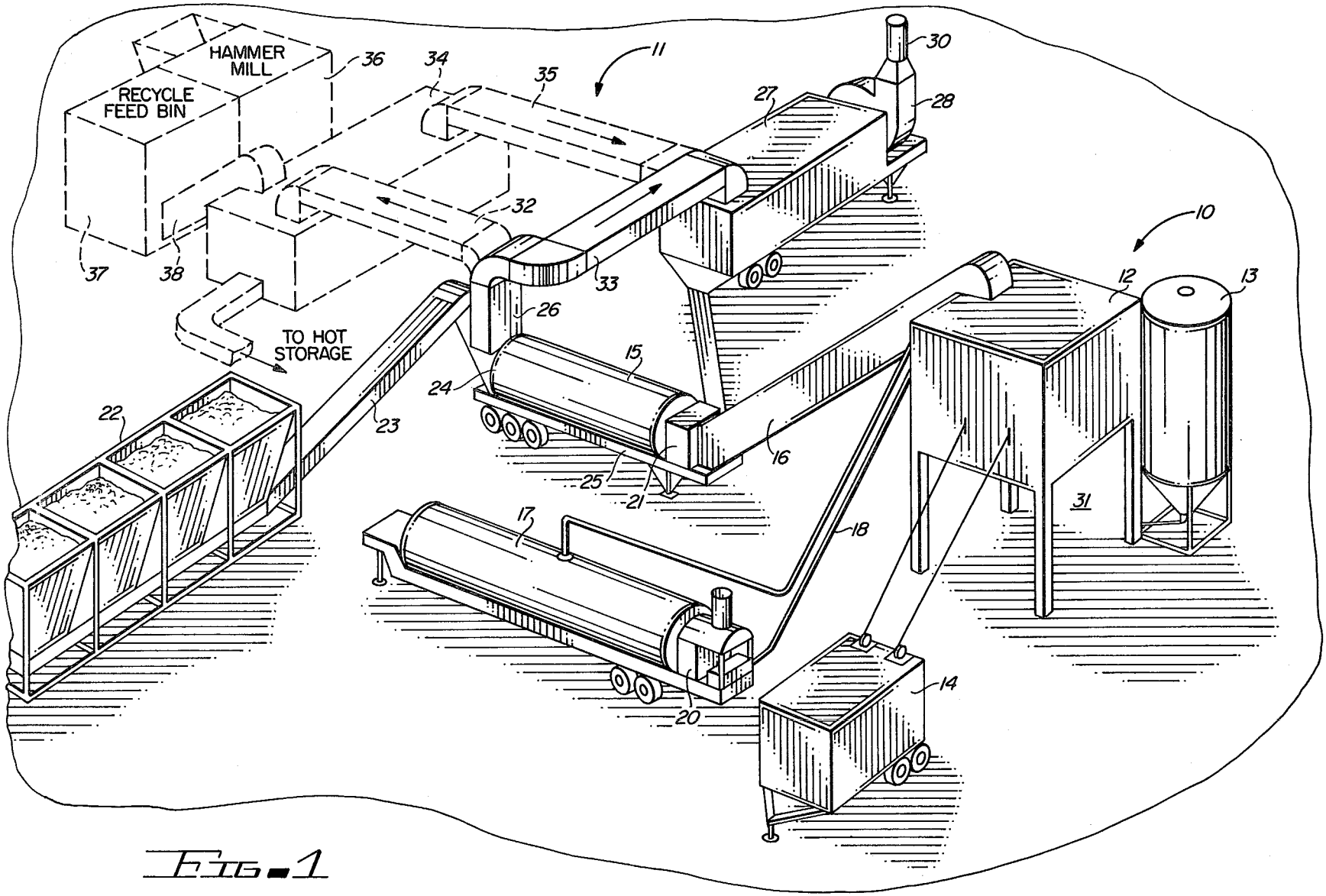
FIG. 1 is a perspective view of a portion of batch type asphalt plant having a recycling asphalt plant phantom view attached thereto.

Referring to FIG. 1, a batch type asphalt plant 10 is shown having an asphalt recycling plant 11 attached thereto. The batch type asphalt plant 10 includes a batching tower 12 having a mineral filler bin 13 adjacent thereto and a plant control room 14 for controlling the operation of the batching tower 12. An aggregate dryer 15 is connected by a slat type conveyor 16 for conveying heated aggregate materials into the batching tower 12. A liquid asphalt storage tank 17 is connected by way of pipes 18 to the batching tower 12. The asphalt storage tank 17 has a heater 20, while the aggregate dryer has an aggregate heating burner 21 on one end thereof. A plurality of storage hoppers 22 may be loaded with different size aggregate materials and are fed by a cold feed conveyor 23 into the dryer 15 and are fed from one end of the dryer 24 to the other end of the dryer 25, while the heated air from the burner 21 passes heated air and gases through the dryer 15 and out the outlet duct 26. The heated aggregate materials are then fed through the conveyor 16 to the batching tower 12 while the heated air and gases containing a large amount of particulate materials are fed to a bag house or a fabric filter dust collector 27 where an air blower 28 directs the cleaned gases through a stack 30. In operation, trucks can be directed to beneath the batching tower 12 in the space 31, mixed with different size aggregates which are screened in the tower 12 mixed with the asphaltic material from the asphalt storage tank 17 and mineral filler material from the mineral filler bin 13 to form the hot asphalt material for use in paving, and the like.

In the present invention, a duct 32 is connected to the duct 26 while a damper is placed in the duct 26 for controlling the flow of the heated gases through the duct portion 33 or through the duct 32, as desired. The heated gases are fed to an asphalt recycling dryer 34 when additional heated air is added to produce the desired amount of heat. The exhaust gases are fed through the duct 35 back to the duct 33, where a damper is placed to control the direction of the flow of gases into the filter system 27. Used asphaltic pavement minerals, or the like, may be dumped into a hammermill 36 to reduce their size to a predetermined aggregate where they are stored in a recycled feed bin 37 and fed into the recycle dryer 34 through a conveyor 38.

Figure 2:
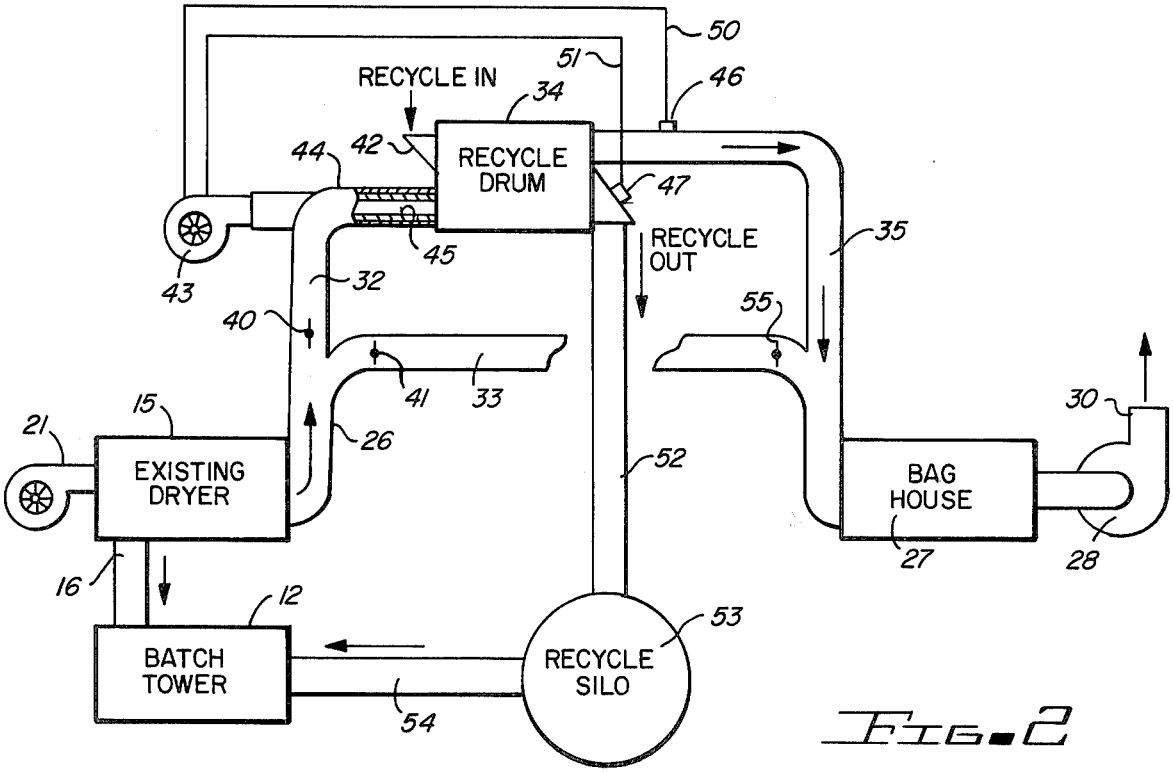
FIG. 2 is a block diagram of an asphalt recycling plant in accordance with the present invention.

The recycling plant may more clearly be seen in connection with FIG. 2, in which an existing dryer 15 has a burner 21 connected to one end thereof and is connected through a conveyor 16 to a batch tower 12. The heated gases are passed through a duct 26 to the bag house 27 and through a blower 28 and out the stack 30. The duct 32 has been added to the duct 26 and a damper 40 and 41 have been placed in the ducts for controlling the heated gases either directly to the bag house 27, or as shown in connection with FIG. 2, into the duct 32 and into the recycling dryer 34. The recycling dryer 34 receives material in the recycling material input 42 and has a booster burner 43 connected to the input duct portion 44 feeding to the recycle drum 34. This portion 44 has refractory material 45 lining the input so that the portion 44 can withstand the added heat from the booster burner 43. The booster burner 43 can be a conventional existing aggregate dryer burner. A temperature sensor 46 is placed on the heated air output from the recycled drum 34 while a temperature sensor 47 is placed on the output for the recycled material from the recycle dryer 34. These temperature sensors are connected by way of lines 50 and 51 to the burner 43 so that the temperature of the recycled material can be maintained at a predetermined level by operating the booster burner 43 as needed to increase the temperature of the heated gases being fed to the recycle dryer 34 from the existing plant dryer 15.

A hot recycling slat type conveyor 52 is connected from the recycling dryer 34 to a hot recycling storage silo 53, which may be connected to an auger or feed type conveyor 54 to the batch tower 12, or it can be mixed with aggregates from the batch type asphalt plant along with liquid asphalt for reuse as paving material, or the like. The heated gases are fed from the recycling dryer 34 through the outlet duct 35 and into the filter system 27 where the gases are filtered. A damper 55 is located in the duct portion 33 so that gases from the existing batch type asphalt plant can be fed through the section 33 directly to the bag house 27 or can alternatively be fed through the connecting duct pipes 32 to the dryer 34 and back through the ducting 35 into the existing duct or directly into the filter system 27.

Figure 3:
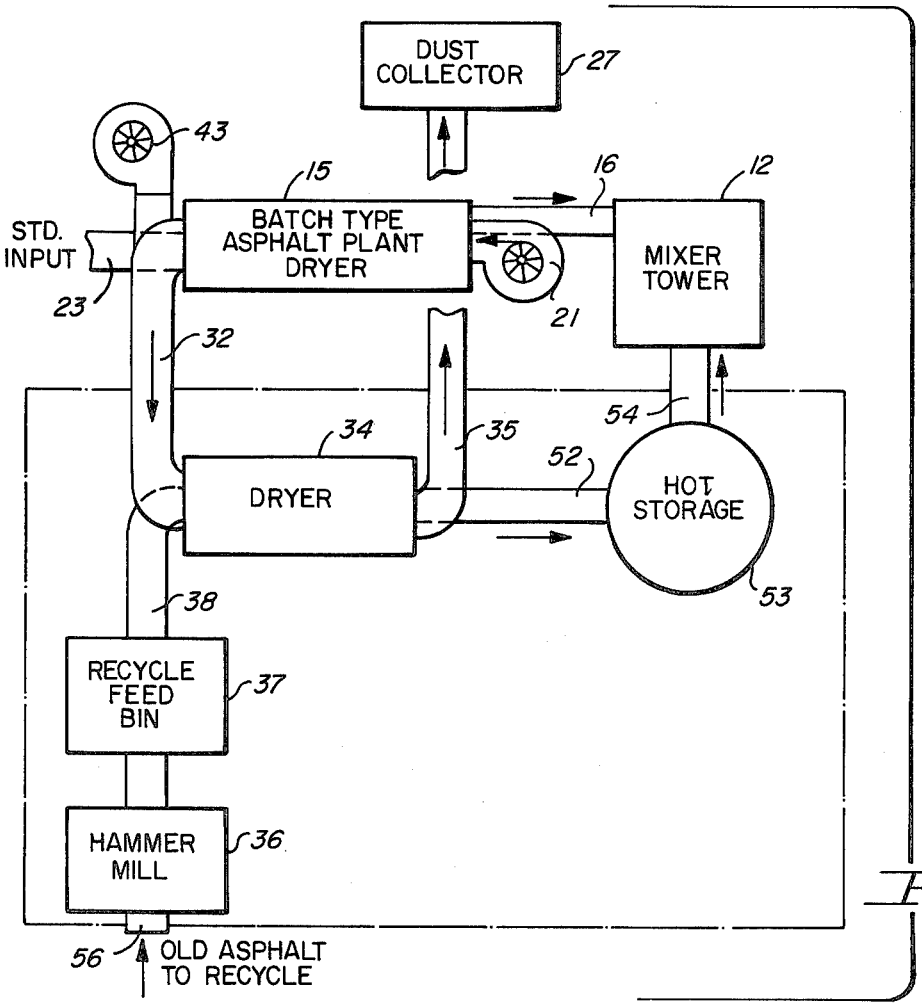
FIG. 3 is another block diagram of a modified recycling asphalt plant in accordance with the present invention.

FIG. 3 shows the entrance of used asphaltic paving material entering the system at the input 56 into a hammermill 36, where it can be broken up into a predetermined size prior to being fed into a cold feeder or recycle feed bin 37, where it is fed through a cold recycle feed conveyor 38 into the recycle dryer 34. The heated and broken up asphalt material is then fed through a hot recycling slat conveyor 52 into the hot recycling storage silo 53 and through the feeder slat conveyor 54 to the mixing or batch tower 12. The original batch type asphalt plant dryer 15 has a burner 21 for directing heated air through the dryer 15 while the standard aggregate materials are fed into the input 23 and out the conveyor 16 to the batch tower 12. The booster burner 43 is placed onto an elbow of the ducting 32 for adjusting the temperature of the gases being fed to the recycling dryer 34 from the batch type asphalt plant dryer 15. The air and heated gases from the dryer 34 are fed through the duct 35 into the dust collector or bag house 27.

It should be clear at this point that an asphalt recycling system has been provided for recycling used asphalt pavement materials and this is done in a process of breaking up the materials in a hammermill 36, feeding the broken up materials through a recycle feed bin 37 and conveyor 38 to a recycle dryer 34. The next step is heating the recycled materials to a predetermined temperature using the waste heat from an existing batch type asphalt plant dryer 15 and adding heat to the material through a booster burner and controlling the booster burner to maintain the temperature in the recycling dryer. The process also includes the step of feeding the heated air from the recycle dryer to the filtering system and feeding the recycle asphalt material to a storage bin and to an existing batching tower.

It should be clear that both a process and a system for reprocessing used asphalt pavement material has been provided which utilizes the waste heat from a batch type asphalt plant as well as existing ducting and filtering system, along with the existing batching tower and controls while reducing the amount of liquid asphalt and mineral filler needed to make up an asphalt batch. This increases the efficiency of the batch type asphalt plant, utilizes the otherwise wasted broken up asphalt materials. The present invention, however, is not to be construed as limited to the forms shown, which are to be considered illustrative rather than restrictive.

I claim:

1. An asphalt recycling system comprising in combination:

an asphalt plant having an aggregate dryer and gas discharge;

an asphalt recycle dryer connected to said asphalt plant dryer for heating used asphalt, said asphalt recycle dryer having an input duct connected to the discharge duct of said asphalt plant dryer, said recycle dryer also having an outlet duct therefrom whereby heated unfiltered air is passed through said recycle dryer from said asphalt plant dryer;

means for breaking up old asphaltic materials;

asphalt recycle feed means connected to said asphalt recycle dryer for feeding old asphaltic materials broken up by said means for breaking up old asphaltic materials to said recycle dryer; and auxiliary booster heat means operatively connected to said asphalt recycle dryer for providing additional heat to said asphalt recycle dryer.

2. An asphalt recycling system in accordance with claim 1, in which said auxiliary heat booster means is a recycle booster burner.

3. An asphalt recycling system in accordance with claim 2, in which said asphalt plant includes a filtering system having ducts connected thereto from said plant gas discharge.

4. An asphalt recycling system in accordance with claim 3, in which said asphalt recycle dryer input duct and said asphalt plant dryer discharge duct have dampers placed therein controlling the passage of heated and filtered gases from said asphalt plant dryer to said asphalt recycle dryer and through the plant discharge duct to said asphalt plant filtering system, whereby heated unfiltered gases may be directed to said filter system through said asphalt recycle dryer or may bypass said asphalt recycle dryer to said filter system.

5. An asphalt recycling system in accordance with claim 4, in which said asphalt plant discharge duct has a portion forming a bypass between an input duct to said asphalt recycle duct and an output duct from said asphalt recycle dryer and has a damper located in said bypass duct asphalt recycle dryer input duct and asphalt recycle dryer discharge duct connection to said existing duct.

6. An asphalt recycling system in accordance with claim 2, in which a temperature sensor is connected to the output of said asphalt recycle dryer, output duct for measuring the heat of the discharge duct, said asphalt sensor being operatively connected to said recycle booster burner.

7. An asphalt recycling system in accordance with claim 6, in which said asphalt recycle dryer has a recycle asphalt discharge and has a temperature sensor placed therein for measuring the temperature of the discharged recycled asphalt material, said sensor being operatively connected to said recycle booster burner.

8. An asphalt recycling system in accordance with claim 7, in which said asphalt recycle dryer input duct has a portion having refractory lining therein.

9. An asphalt recycling system in accordance with claim 8, in which said asphalt recycling dryer recycling asphalt material discharge includes a conveyor connecting said asphalt recycle dryer to an asphalt recycle storage means.

10. An asphalt recycling system in accordance with claim 9, including a storage means having a conveyor connecting said storage means to an existing asphalt plant batch tower.

11. An asphalt recycling system in accordance with claim 1, in which said means for breaking up old asphaltic materials includes a hammermill connected to said asphalt recycle feeder means for reducing the size of recycled asphalt materials.

12. A process of recycling asphalt materials in an asphalt plant having a dryer producing waste heated gases therefrom comprising the steps of:

breaking up old asphaltic materials;

feeding said broken up asphaltic materials to a recycle dryer;

directing heated gases from an asphalt plant asphalt dryer into said recycling dryer;

adding additional heated air to said recycling dryer from an auxiliary heat source;

heating said old asphaltic materials in said recycling dryer;

discharging gases from said recycle dryer to an exhaust system; and feeding recycled asphalt materials from said dryer.

13. A process in accordance with claim 12, including the step of sensing the temperature of said heated gases discharged from said recycle dryer for controlling the addition of heated air to said recycle dryer.

14. A process in accordance with claim 13, including the step of sensing the temperature of recycled asphalt materials discharged from said recycling dryer for controlling the heated air added to said recycling dryer.

15. A process in accordance with claim 14, including the step of controlling the flow of heated gases from said asphalt plant to said recycling dryer with dampers.

16. A process in accordance with claim 15, including the step of feeding recycled asphalt materials from said asphalt storage bin to a batching tower of said asphalt plant.

* * * * *